United States Patent [19]

Guillaume

[11] 4,239,465

[45] Dec. 16, 1980

[54] ROTARY MOTOR WITH ALTERNATING PISTONS

[76] Inventor: Claude Guillaume, 57b rue de la Paix-57, Rombas, France

[21] Appl. No.: 910,288

[22] Filed: May 30, 1978

[30] Foreign Application Priority Data

Jun. 3, 1977 [FR] France ..... 77 17019

[51] Int. Cl.[3] ..... F01C 1/063

[52] U.S. Cl. ..... 418/35

[58] Field of Search ..... 418/33, 35; 123/245

[56] References Cited

U.S. PATENT DOCUMENTS

| | | | |
|---|---|---|---|
| 785,884 | 3/1905 | Huntington | 418/35 |
| 932,321 | 8/1909 | Plates | 418/35 |
| 1,196,028 | 8/1916 | Roseman-Rozewski | 418/35 |
| 1,318,017 | 10/1919 | Shank | 418/35 |

FOREIGN PATENT DOCUMENTS

| | | | |
|---|---|---|---|
| 696615 | 10/1930 | France | 418/35 |

*Primary Examiner*—John J. Vrablik

*Attorney, Agent, or Firm*—Flynn & Frishauf

[57] ABSTRACT

A rotary internal combustion motor comprises a toroidal chamber with symmetry of rotation to the rotor axis, in which pistons travel and comprising locking and unlocking means for making the said pistons alternately solid with the rotor and the housing. The locking means include arcuate formations on swivel pins which travel with the pistons and can engage complementary grooves on radially floating members on the housing and rotor.

15 Claims, 16 Drawing Figures

ROTARY MOTOR WITH ALTERNATING PISTONS

The present invention concerns a rotary internal combustion motor, comprising a toroidal chamber with symmetry of rotation in relation to the rotor axis, in which pistons travel and comprising means of locking and unlocking making the said pistons alternately solid with the rotor and the housing.

In these types of motor, already known, a major drawback exists residing in the fact that the pistons are fixed alternately on the rotor or on the housing via radial keys engaging perpendicularly in apertures providing for this purpose and controlled by cams.

The drawback of such a system is that it is very abrupt, offers no reliability owing to the risk of rapid wear and damage, and offers no flexibility, even with the creation of a stopping time due to the escape of disengaged keys; moreover, lubrication of moveable parts, like the sealing between the chamber and the housing, is very difficult to ensure.

The present invention has for principal object the correction of the drawbacks indicated above while offering a rotary internal combustion motor offering a great flexibility of operation, combined with a great reliability, and reduced risks of abnormal wear and breakage.

These problems are resolved in conformance with the invention in a rotary internal combustion motor comprising a rotor and a toroidal chamber in which at least two pistons are relatively moveable and comprising locking and unlocking coupling means for making each piston alternately solid with the rotor and with the housing, the coupling means being parts engaging and disengaging in corresponding parts of complementary shape, along a tangential or circumferential path of movement in relation to the rotation movement of the rotor, thereby allowing smooth locking and unlocking. According to one variant of embodiment of the invention, the said means of locking and unlocking of the pistons are formed by swivel cams pivoting over 90°, whose end faces each carry a tenon, the said tenons being orthogonal in relation to one another and engaging or disengaging in mortise channels of complementary shape in members mounted on the rotor or the housing, according to a circumferential movement in relation to the movement of the rotor.

According to another feature of the invention, the locking of the pistons on the rotor and the unlocking of these latter from the housing and the reverse operations are simultaneous and instantaneous, which allows a regular rotation of the motor.

According to a third feature of the object of the invention, in the case of a rotary motor comprising four pistons, the pistons are fixed two by two, being diametrically opposite on a ring centered on the axis of the rotor, and each piston is provided with two discs fixed on the corresponding ring forming a peripheral sealing between the chamber and the housing (which confers a certain lightness on the said pistons), and each ring is equipped with, on the radial axis of each piston, locking and an unlocking members.

In conformance with the invention control of the locking and unlocking of the pistons in relation to the housing and the rotor is realised by means of slides provided with a crank pin sliding radially and connected to the pivoting swivel cam for locking and unlocking, by means of a pivot stud eccentric in relation to the axis of the swivel cam.

According to a further preferred feature of the invention, two successive pistons are connected by two sets of two links controlling the slides connected to the locking and unlocking members of the pistons, one set of links being connected to the slide of one piston and with the connecting bracket of the following piston, and the other set of links connecting the connecting bracket of the first-mentioned piston and with the slide of the preceding piston, this forming, for starting and stopping positions, in a rotary motor possessing four pistons, two sets of oppositely connected links that are loosened while the two other opposite sets of links are tightened.

According to another aspect of the invention the locking and unlocking members of the pistons are aligned on the same circle as the complementary parts of the rotor and the housing, and on locking, certain members slide radially towards the center and are then resiliently pushed back onto this circle.

According to the invention, the end discs of the pistons have the shape of a Σ in transverse section, having a circular periphery and a groove at right angles to the axis of the spark-plug provided between pistons.

Such pistons may be formed of two end discs fixed via cross-pieces on longitudinal members forming the extension of the rings. Each disc, moreover, preferably includes on its periphery three piston ring seals.

The motor can include a centrifugal lubrication system for the pistons with funnels placed on the connecting brackets of the pistons and connecting in the space located between two pistons via a passage, the lubrication of the valves being ensured by inertia.

With two piston pairs, the motor can comprise three firing cycles set at 120° and each involving 60° path for the piston, the first firing cycle taking place in the reverse direction from the direction of rotation of the rotor, there being six cycles to one rotation of the rotor.

In the rotary motor according to the invention, a system of intake and exhaust valves, self-operated and mounted directly on the toric chamber, can be provided.

Finally, a shock absorption system can be provided for the valves, composed of a seating fitted with pressure springs and sealing segments, which can serve as a system for taking up the automatic play, as in a conventional motor.

An embodiment of the motor according to the invention will now be described with reference to the attached drawings, in which:

FIGS. 1*a* and 1*b* show a side elevation along the sections 1A-1A and 1B-1B, respectively, of FIG. 2.

FIG. 7, formed from FIGS. *7a,b,c,* shows diagrams making clear the locking of the swivel cams.

Figure 9:
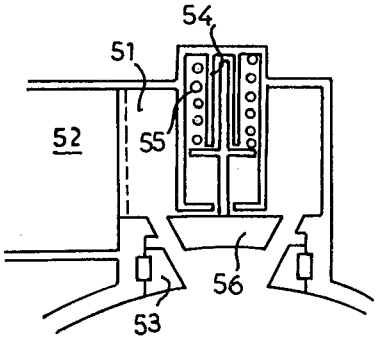
Figure 8:
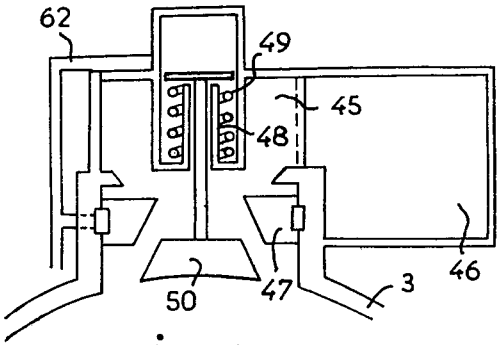

FIGS. 8 and 9 show sections of the intake and exhaust valves.

Figure 10:
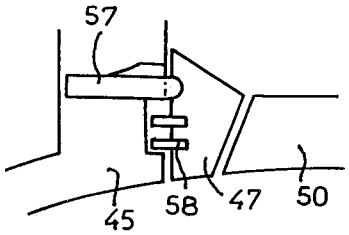

FIG. 10 shows a section of the shock absorption system of the valves.

Figure 11A:
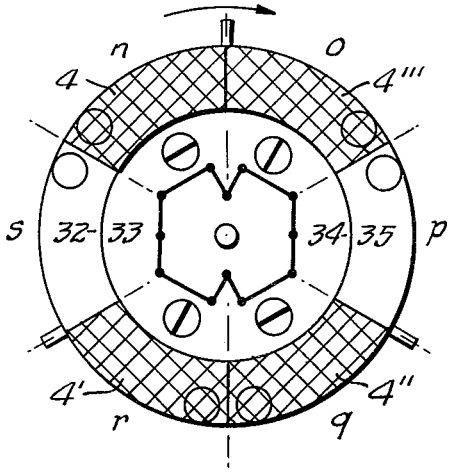

FIG. 11 formed from FIGS. 11*a,b,c,* represents diagrammatically the three cycles of operation of the motor.

We shall hereafter give the general discription of the rotary motor according to the invention.

The rotary motor shown in the drawings comprises a rotor 5 mounted on a shaft 1 and turning in a housing 2, 2' delimited by a toroidal chamber 3; this last is slotted on the whole of its inner circumference and the slot has flanges 6, 6'; extending inwardly to guide two rings 7 and 8, on which are mounted the pistons, further described below, that move in the toroidal chamber 3. Conventional seals 9 indicated by a heavy line are provided between the rings and between each of the flanes 6,6' and the adjacent ring 7 or 8.

Figure 1A:
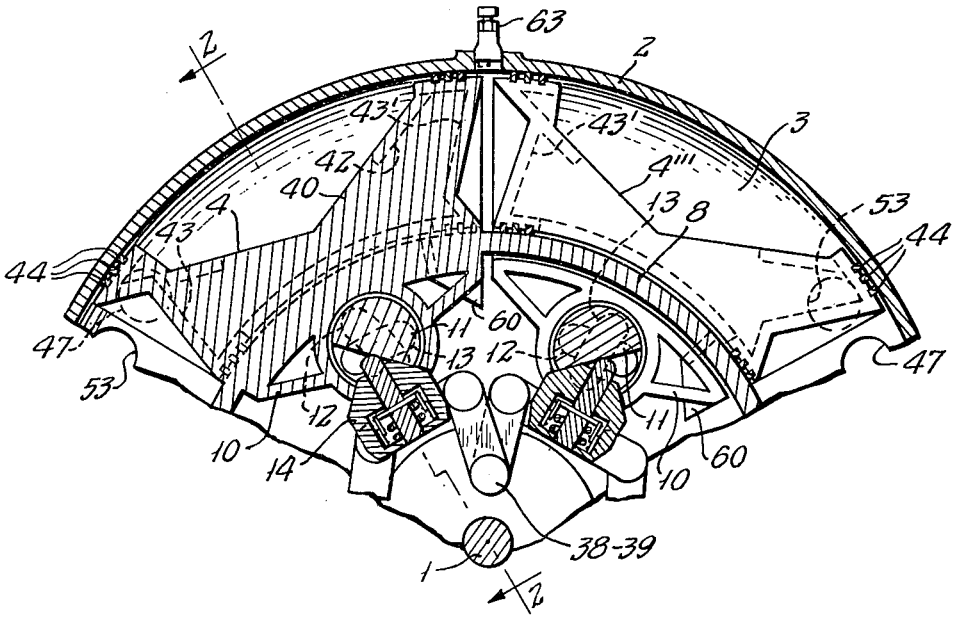
Figure 1B:
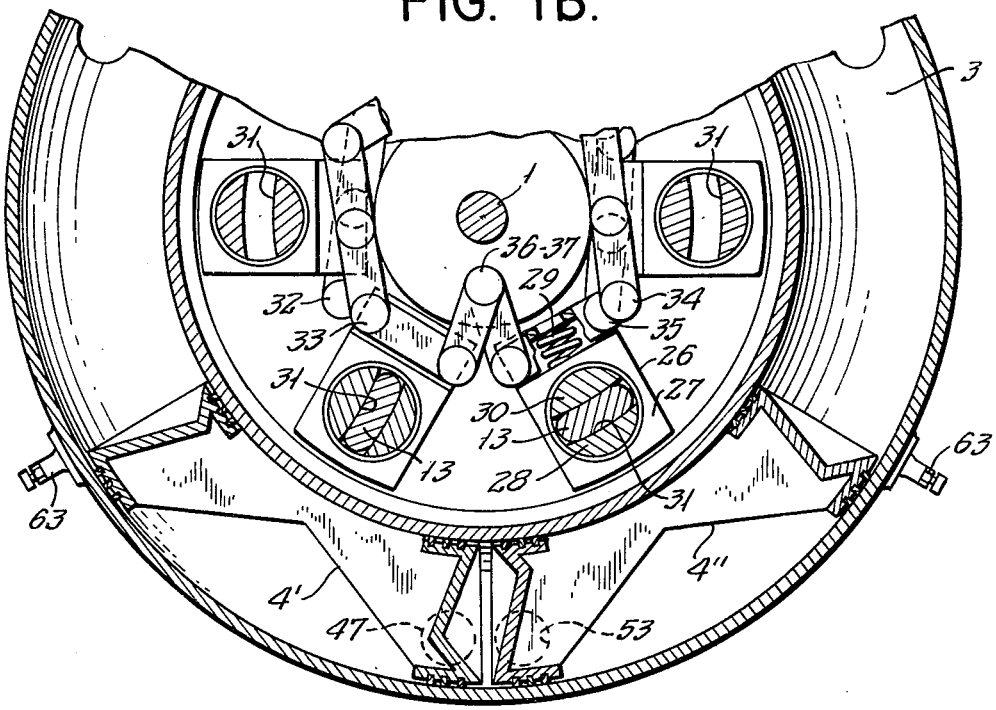
Figure 2:
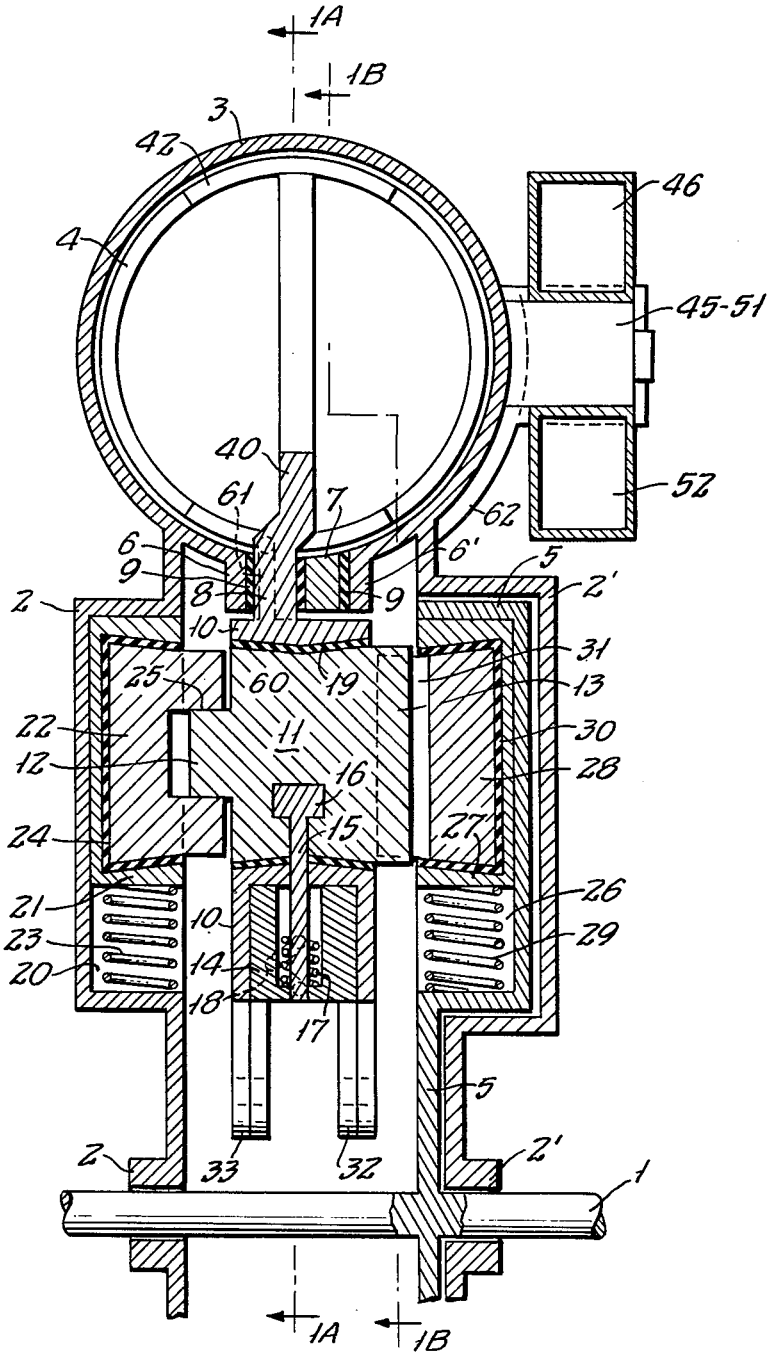
FIG. 2 represents a view of the motor of FIG. 1, taken along the section 2—2 of FIG. 1*a*.
Figure 3:
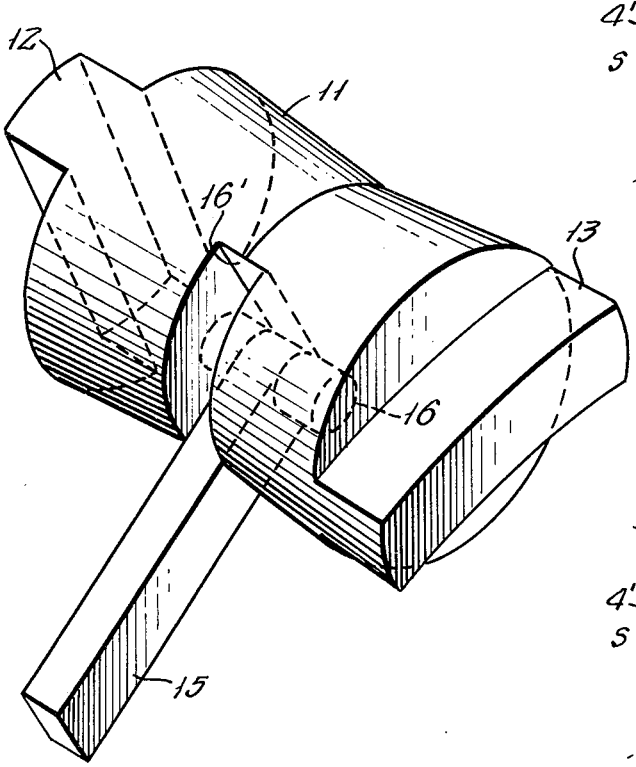
FIG. 3 is a view in perspective of a swivel cam used in the motor of FIGS. 1 and 2.

Pistons 4, 4'' are set at 180° on the ring 8 and the pistons 4', 4''' set at 180° on the ring 7. Each piston comprises two end discs 43, 43' fixed by cross-pieces 42 on a longitudinal member 40 which is the extension of the ring 7 or 8 to which the piston is attached. The faces of the discs 43 in shape in transverse section and having a circular contour are, as shown in FIG. 1, grooved at right angles to axis of the the spark-plug 63 located on the outer periphery of the chamber 3 between each pair of pistons. The toric side parts 41 of the pistons, include three piston-ring seals 44 of known type. In the radial axis of each piston the mounting ring 7 or 8 is extended by a connecting bracket 10 carrying a swivel cam 11 of bifrusto-conical appearance (FIG. 3) with a shock-absorber surface 19 (FIG. 2) indicated by a thickened line. A slide 14 is mounted to slide on the rod 15 within limits set by the links 18 and subject to the force of a spring 17 urging the slide towards the swivel cam 11. The connecting rod 15 is pivoted by studs 16 in a slot 16' in the swivel pin 11.

A set of links is fixed between the slide 14 of a piston and the connecting bracket 10 of the other piston, while the other set of links is fixed in reverse fashion, these sets of links being numbered 32 to 39.

The housing 2 comprises six coupling assemblies all set 60° apart and each of which (FIG. 2) comprises a radial guideway 20 in which is placed a support 21 fitted with a return spring 23 and a frusto-conical mortised member 22, able to pivot 90°, fitted with a shock-absorber surface 24 (indicated by a heavy line) and provided with a mortise cavity 25 in the shape of a groove of rectangular cross-section on its face.

The rotor 5 also comprises six coupling assemblies all set 60° apart and having corresponding parts numbered from 26 to 31 and having the same functions in accordance with the following tabulation:

Table

| Parts of Coupling Assemblies | | |
|---|---|---|
| Name of Part | Housing 2 | Rotor 5 |
| Radial guideway | 20 | 26 |
| Support | 21 | 27 |
| Return Spring | 23 | 29 |
| Mortised slide member | 22 | 28 |
| Shock abs. layer | 24 | 30 |
| Mortise channel | 25 | 31 |

The torsidal chamber 3 has three spark plugs 63 set 120° apart and three assemblies comprising an intake valve (FIG. 8) and an exhaust valve (FIG. 9), which are equidistant between the spark plugs. The induction intake valve (FIG. 8) comprises a pipe 45 connecting with a manifold 46 and also with the chamber 3 at 47 and a guide 48 in which the valve stem moves; the valve 50 is urged to closure by a spring 49 against a seat 47 and to open by the intake stroke vacuum. The exhaust valve (FIG. 9) comprises the same elements as the intake valves but operates to opposite effect. The valve 56 is urged to closure by a spring 55 against a seat 53 and to open by the over-pressure resulting from the exhaust strokes.

The valves 50, and do 56 have automatic taking up of play, not have their excursion limited by cams.

The intake valve seat 47 (FIG. 10) forming a shock-absorber of trapezoidal appearance is supplied with four flat springs 57 set in the pipe 45; two conventional joints 58 are provided as a seal between the seat 47 and the pipe 45. This apparatus avoiding for flattening is of the kind that can replace an automatic system for taking up play in a conventional motor.

With regard to the lubrication system, it is formed, in the case of the pistons, by funnels 60 with centrifugal effect, fixed on the connecting brackets 10 of the pistons and connecting with the space 59 between pistons rings 44 via a passage 61. In the case of the valves, lubrication is effected by inertia via a passage 62 connected to the housing 2'.

The operation of the rotary motor according to the invention in the case of a path of 60° (FIGS. 4, 5, 6, 7, a, b, c) will be described hereafter.

The piston 4 locked or coupled to the rotor, having just moved through a path of 60°, has produced compression between the faces 43 of the pistons 4 and 4'. Before the end of the path, the tenon 12 of the piston 4''' fits into the mortise channel 25 of the a mortised member 22 of the housing 2, and a set of articulated links 32, 33 fixed to the slide 14 of the piston 4 and to the connecting bracket 10 of the piston 4''' is tightened (FIGS. 4 and 5) and pulls the slide leftwards as well as the connecting rod 15 which, by its studs 16 lodged in the swivel cam 11, causes this latter to pivot 90° (FIG. 7*a*).

The tenon 12 and the channel 25, in which it is engaged, rotate and draw the support 21 along, which compresses the spring 23 (FIG. 7*b*) as the slide 14 is pulled radially inward.

Figure 7C:
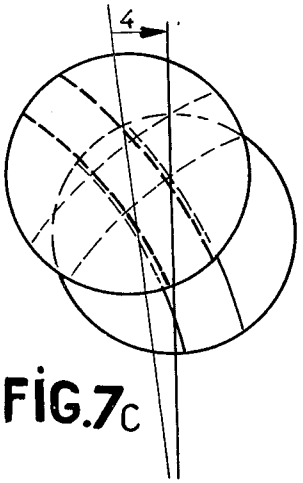
Figure 7B:
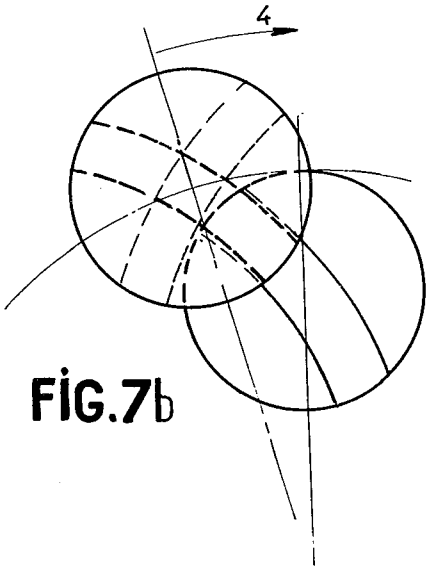
Figure 7A:
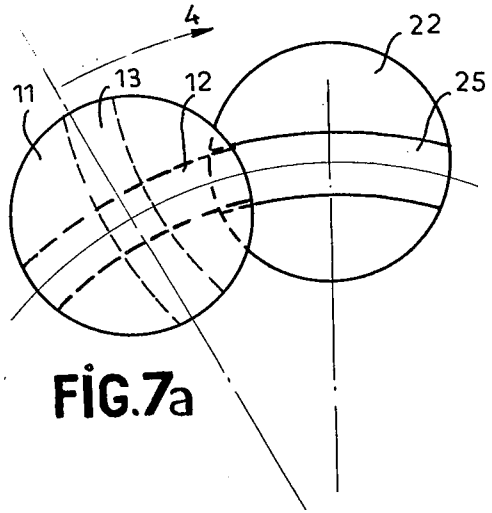

Before the end of rotation, the spring 23 pushes the support 21 back up to full registry of channel and tenon (FIG. 7*c*).

The piston 4 is then coupled to the housing, as the swivel cam's tenon 12 and the channel 25 assume a radial orientation. The other tenon 13 of the swivel cam engages in the channel 31 of the rotor and makes the channel 13 rotate on its axis, the support 27 staying in place without compression of the spring 29.

The piston 4 is freed from the rotor while the tenon 13 of the swivel cam and the channel 31, following on the circle on which their median lines travel, are ready for a subsequent coupling. The piston 4''' being coupled to the housing, before the end of its travel, a set of links 33 is tightened and pulls the slide 14 rightwards, producing the reverse operation to that described.

The piston 4''' is thereby coupled to the rotor and freed from the housing.

The connecting rod 15 of the slide 14 is supplied with a spring 17 for keeping the swivel cam 11 fixed on the housing or on the rotor. A pair of links 18 provide limits for the travel of the connecting rod 15.

The links 32 to 39 each include a spring (not shown) fixed on one of the links and resting on the other link so as to allow an immediate folding upon release of tension.

The operation of the motor will be made clear by reference to FIGS. 11*a, b, c.*

The operation is described for the three cycles of the motor, namely 180° (60°×3), of revolution of the rotor, the pistons 4, 4', 4'' and 4''' respectively assuming the positions 4''', 4, 4', 4'' for 180° to 360° of revolution of the motor.

Rotation is produced in the clockwise direction and only the tenon-guiding channels of the rotor are represented.

Figure 11B:
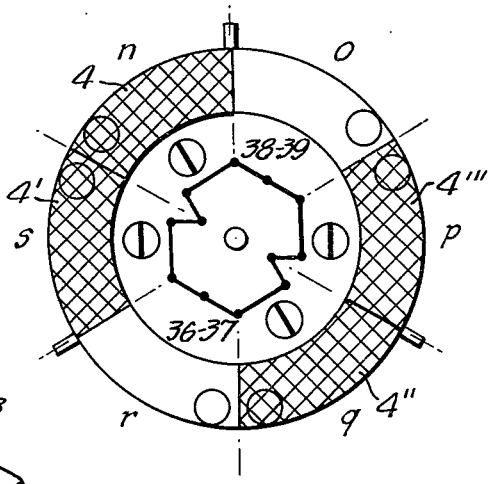

Changeover from the state in FIG. 11*a* to that in FIG. 11*b:*

The tightened links 32, 33 and 34, 45 have fixed the pistons 4',

The piston 4''' at (o) travels 60° and comes to (p); there is explosion at (o) and compression at (p).

The piston 4' at (r) travels 60° and comes to (s); there is aspiration at (r) and exhaust at (s).

Figure 11C:
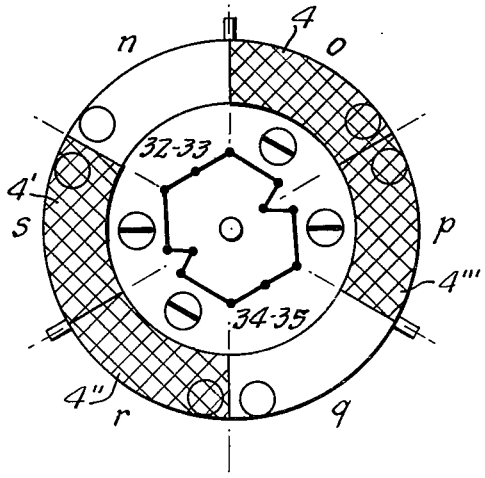
Figure 5:
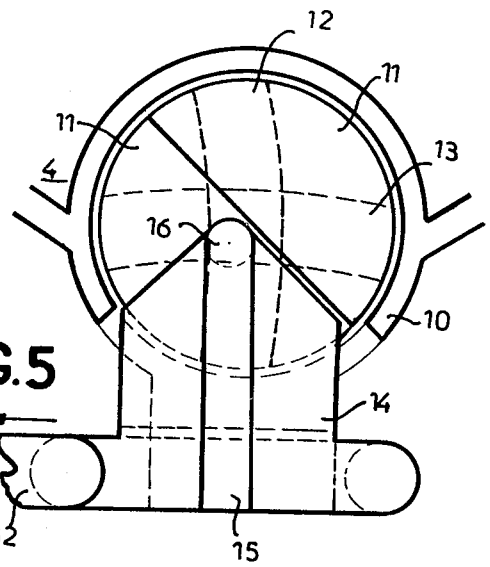
FIGS. 4 and 5 show transverse sections of the swivel cams and of their control parts.
Figure 4:
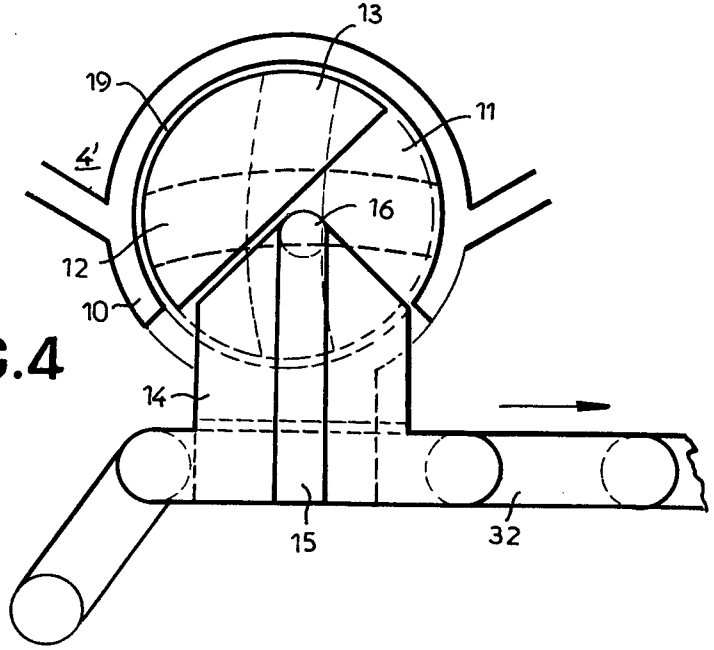
Figure 6:
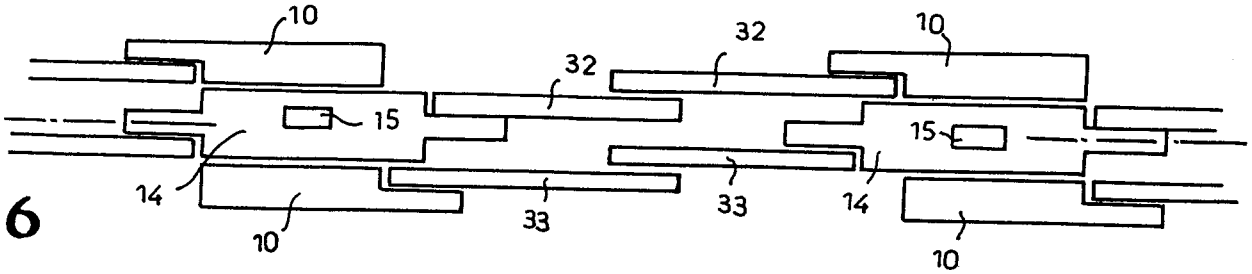
FIG. 6 shows a view from above of the assembly represented in FIGS. 4 and 5.

Changeover from the state in FIG. 11*b* to that in FIG. 11*c:*

The tightened links 36, 37 and 38, 39 have fixed the pistons 4, 4'' on the rotor and 4', 4''' on the housing.

The piston 4'' at (q) travels 60° and comes to (r); there is explosion at (q) and compression t (r).

The piston 4 at (n) travels 60° and comes to (o); there is aspiration at (n) and exhaust at (o).

Changeover from the state in FIG. 11*c* to that in FIG. 11*a:*

The tightened links 32, 33 and 34, 35 have fixed the pistons 4', 4''' on the rotor and 4, 4'' on the housing.

The piston 4'''at (p) travels 60° and comes to (q); there is exhaust at (q) and aspiration at (p).

The piston 4' at (s) travels 60° and comes to (n); there is explosion at (s) and compression at (n).

I claim:

1. A rotary internal combustion motor comprising a toroidal chamber, a stationary casing for mounting said chamber and for mounting machinery of said motor adjacent to said chamber and in the vicinity of the axis of said chamber, a rotor mounted on said casing for rotation coaxially with said toroidal chamber, at least two pistons movable relative to each other in said toroidal chamber in motion swinging about said axis of said chamber, coupling means for locking each of said pistons, in the circumferential direction about said axis, alternately to said rotor and to said casing, in such a way that each piston is locked to said rotor and unlocked from said casing while the other is locked to said casing and unlocked from said rotor, and further comprising the improvement which consists, at least, in that:

said coupling means comprise members arranged to engage and to disengage by relative movement having a component of circumferential movement about said axis and to provide by swiveling a transition between completely circumferential movement at the beginning of engagement and an at least partially radial movement at the end of engagement and also a swiveled transition preparatory for disengagement by circumferential sliding movement.

2. A rotary internal combustion motor as defined in claim 1 in which said coupling means are constituted so that the locking of one piston to said motor and the unlocking of the other of said pistons from said rotor occur simultaneously and, likewise, the locking of one piston to said casing and the unlocking of the other of said pistons from said casing occurs simultaneously.

3. A rotary internal combustion motor as defined in claim 1 in which two pairs of pistons are provided, the pistons of each pair being diammetrically opposed to each other and mounted on a common ring, a separate ring being provided for each pair of pistons, each ring carrying members of said coupling means for locking and unlocking the pistons carried by the ring, each of said pistons having a piston head at each circumferential end of the piston, which piston head is sealed to said toroidal chamber by means of piston rings.

4. A rotary internal combustion motor as defined in claim 3 in which said piston heads of each piston are formed with a depression having a radially outwardly extending groove for allowing the interposition of a sparkplug mounted on said casing between facing piston heads of two adjacent pistons.

5. A rotary internal combustion motor as defined in claim 3 in which each piston head is provided with gusset members securing said piston heads directly or indirectly to a ring member, said ring member being circumferentially movable in a slot in said chamber.

6. A rotary internal combustion motor as defined in claim 3 in which funnels are provided on the connection brackets of the pistons to service in a centrifugal lubrication system for the pistons, and passages are provided connecting said funnels with the space located between adjacent pistons.

7. A rotary internal combustion motor as defined in claim 3 in which said members of said coupling means comprise a swivel cam mounted on a connecting bracket affixed to each of said pistons for swiveling about an axis parallel to said axis of said chamber and having on its respective axial ends tenon cams substantially orthogonal to each other, a swiveling member having a complementary mortise cam mounted on said casing at each of a plurality of uniformly distributed locations, greater in number than the number of pistons, suitable for intermittent engagement with said swivel cams and a swiveling member having a complementary mortise cam mounted on said rotor at each of a set of locations corresponding to the locations of said swiveling members mounted on said casing but at the other side of said brackets said swivel cams, said mortised swiveling members being mounted so as to swivel about an axis parallel to the axis of said chamber and having mortise cams shaped for engagement with the tenon cams of said swivel cam member.

8. A rotary internal combustion motor as defined in claim 7 in which there are just two pairs of diammetrically opposite pistons, in which said locations of said swiveling members of said coupling means mounted on said casing are located on centers set at 60° intervals around said axis and in which three sparkplugs set 120° apart are provided in said toroidal chamber.

9. A rotary internal combustion motor as defined in claim 3 in which there are just two pairs of diammetrically opposite pistons and in which the connecting brackets of a piston has a first linkage comprising a pair of articulated links interconnecting the slider of the swivel cam on its said bracket to the connecting bracket of an adjacent piston of the other pair and has a second linkage comprising a pair of articulated links interconnecting the connecting bracket of said first piston with the slider of the swivel cam on the connecting bracket of an adjacent piston of said other pair.

10. A rotary internal combustion motor as defined in claim 9 in which said tenon cams and said mortise cams of said members of said coupling means are curved along their length dimension with a radius of curvature corresponding to the radial position of said cams with respect to said axis at the beginning of engagement and the end of disengagement.

11. A rotary internal combustion motor as defined in claim 1 in which said members of said coupling means comprise a swivel cam mounted on a connecting bracket affixed to each of said pistons for swiveling about an axis parallel to said axis of said chamber and having on its respective axial ends tenon cams substantially orthogonal to each other, a swiveling member having a complementary mortise cam mounted on said casing at each of a plurality of uniformly distributed locations, greater in number than the number of pistons, suitable for intermittent engagement with said swivel cams and a swiveling member having a complementary mortise cam mounted on said rotor at each of a set of locations corresponding to the locations of said swiveling members mounted on said casing but at the other side of said brackets and swivel cams, said mortised swiveling members being mounted so as to swivel about an axis parallel to the axis of said chamber and having mortise cams shaped for engagement with the tenon cams of said swivel cam member.

12. A rotary internal combustion motor as defined in claim 11 in which funnels are provided on the connecting brackets of the pistons for service in a centrifugal lubrication system for the pistons, and passages are provided connecting said funnels with the space located between adjacent pistons.

13. A rotary internal combustion motor as defined in claim 11 in which each of said coupling means is provided with a slider mounted for movement toward and away from said axis and connected to the swivel cam of said coupling means by a connecting rod capable of swinging about a pivot eccentrically located in the body of said swivel cam with respect to the swivel axis thereof, and in which the members of said coupling means mounted on said casing and on said rotor are mounted respectively thereon by supports movable, in radial guideways in which restoring springs are provided, for movement in response to movement of said slider transmitted by said connecting rod to its swivel cam.

14. A rotary internal combustion motor as defined in claim 13 in which the connecting brackets of a piston has a first linkage comprising a pair of articulated links interconnecting the slider of the swivel cam on its said bracket to the connecting bracket of an adjacent piston and has a second linkage comprising a pair of said first piston with the slider of the swivel cam on the connecting bracket of an adjacent piston.

15. A rotary internal combustion motor as defined in claim 14 in which said tenon cams and said mortise cams of said members of said coupling means are curved along their length dimension with a radius of curvature corresponding to the radial position of said cams with respect to said axis at the beginning of engagement and the end of disengagement.

* * * * *

UNITED STATES PATENT AND TRADEMARK OFFICE

CERTIFICATE OF CORRECTION

PATENT NO. : 4,239,465

DATED : December 16, 1980

INVENTOR(S) : CLAUDE GUILLAUME

It is certified that error appears in the above—identified patent and that said Letters Patent is hereby corrected as shown below:

IN THE CLAIMS:

Column 8, claim 14, line 22: after "pair" insert -- of articulated links interconnecting the connect-brackets--.

Column 3, line 14: replace "flanes" with --flanges--.

Column 4, line 10: after "play," insert --and do--.

line 31: replace " 4' " with --4'"--.

line 32: replace " 4'" " with --4--.

Column 5, line 15: replace "45" with --35--.

Column 4, line 9: delete "and do".

Signed and Sealed this

Ninth Day of February 1982

[SEAL]

Attest:

GERALD J. MOSSINGHOFF

Attesting Officer

Commissioner of Patents and Trademarks